US005900797A

United States Patent [19]

Dougauchi

[11] Patent Number: 5,900,797

[45] Date of Patent: May 4, 1999

[54] COIL ASSEMBLY

[75] Inventor: Kazuo Dougauchi, Fukui-ken, Japan

[73] Assignee: Murata Manufacturing Co., Ltd., Nagaokakyo, Japan

[21] Appl. No.: 08/561,586

[22] Filed: Nov. 21, 1995

[30] Foreign Application Priority Data

Nov. 28, 1994 [JP] Japan ..... 6-292499

[51] Int. Cl.[6] ..... H01F 5/00; H01F 27/28

[52] U.S. Cl. ..... 336/200; 336/232; 336/223

[58] Field of Search ..... 336/200, 232, 336/223

[56] References Cited

U.S. PATENT DOCUMENTS

| | | | |
|---|---|---|---|
| 3,898,595 | 8/1975 | Launt | 335/152 |
| 4,547,961 | 10/1985 | Bokil et al. | 336/200 |
| 4,959,631 | 9/1990 | Hasegawa et al. | 336/83 |
| 5,430,424 | 7/1995 | Sato et al. | 336/200 |
| 5,479,695 | 1/1996 | Grader et al. | 29/602.1 |
| 5,515,022 | 5/1996 | Tashiro et al. | 336/200 |
| 5,572,180 | 11/1996 | Huang et al. | 336/200 |
| 5,578,981 | 11/1996 | Tokuda | 336/171 |
| 5,583,424 | 12/1996 | Sato et al. | 323/282 |
| 5,598,135 | 1/1997 | Maeda et al. | 336/200 |
| 5,631,822 | 5/1997 | Silberkleit et al. | 363/144 |

FOREIGN PATENT DOCUMENTS

| | | | |
|---|---|---|---|
| 5-152134 | 6/1993 | Japan | 336/200 |

*Primary Examiner*—Michael L. Gellner
*Assistant Examiner*—Anh Mai
*Attorney, Agent, or Firm*—Burns, Doane, Swecker & Mathis, LLP

[57] ABSTRACT

A coil assembly includes a first magnetic mother board, and a second magnetic mother board. A coil is formed on the first magnetic mother board and composed of stacked coil conductors and insulating layers. A recess or groove is formed in the second magnetic mother board and has a shape corresponding to the shape of the coil. The coil is closely fit into the recess so as to insure connection of the first and second magnetic mother boards. Direct connection of the first and second magnetic mother boards provides a completely closed magnetic path. The insulating layers have no magnetic materials so as to provide a better electromagnetic connection.

20 Claims, 5 Drawing Sheets

COIL ASSEMBLY

BACKGROUND OF THE INVENTION

1. Field of the Invention

The present invention relates to a coil assembly, particularly a coil assembly used as a transformer, an inductor or other components.

2. Description of the Related Art

A conventional coil assembly is shown in FIG. 10. Specifically, a coil assembly 41 includes a core 42 and a wire 43 wound around the core 42. The core 42 has a rectangular base. The wire 43 has ends connected to respective external terminals 44 which, in turn, are attached to the rectangular base of the core 42.

FIG. 11 shows another coil assembly known in the art and made from stacked green sheets. Specifically, a coil assembly 51 includes stacked green sheets made of a magnetic material, and a plurality of coil conductors 52*a*, 52*b*, 52*c*, and 52*d* provided on the surface of the stacked green sheets. Two external electrodes 56 and 57 are attached to the green sheets after the green sheets are integrally sintered. The green sheets include via holes through which the coil conductors 52*a* to 52*d* are electrically connected in series to form a coil 52.

FIG. 12 also shows a conventional coil assembly 61 which includes a coil 62 composed of stacked green sheets and including coil conductors, and two magnetic cores 63 and 64 between which the coil 62 is sandwiched. The green sheets are made of an insulating material and have no magnetic material.

Of these, the coil assembly 41 shown in FIG. 10 is low in productivity and is costly since it is necessary to wind the wire 43 around each core 42. It is also necessary to solder or otherwise electrically connect the wire 43 and the external terminals 44 together because these two parts are made of different materials. This connection is required for each coil assembly. The coil assembly 41 can not be made into a compact arrangement since it is difficult to handle the core 42 and the wire 43 if they are small.

The coil assembly 51 shown in FIG. 11 is high in productivity and is easy to handle as the coil conductors 52*a* to 52*d* can be formed by a printing or photolithographic process and major parts can be incorporated into the board. The coil assembly 51 can also be made into a compact arrangement since the coil conductors 52*a* to 52*d* are thin and fine. However, the electric property of the coil assembly 51 varies based on the degree of contraction of the magnetic green sheets during sintering process. Also, a closed magnetic path is formed in each of the magnetic green sheets, thereby deteriorating the electromagnetic property of the coil 52. Particularly, when the coil assembly 51 is used as a transformer, such closed magnetic path weakens the electromagnetic coupling between the coils and deteriorates the performance of the coil assembly.

The coil assembly 61 provides a better electromagnetic property as the insulating green sheets forming the coil 62 have no magnetic material. This assembly, however, requires a separate effective magnetic path. It is thus necessary to provide the magnetic cores 63 and 64. This results in a reduction in the productivity of the coil assembly 61. It is known to form a magnetic path by printing or otherwise applying a resin mixed with magnetic powder to encase the coil 62, each of the thus formed magnetic cores 63 and 64 having rugged mating surfaces. The resulting resinous material has a magnetic permeability one hundredth to one ten thousandth that of the magnetic material per se and can not provide an effective magnetic path.

SUMMARY OF THE INVENTION

Accordingly, it is object of the present invention to provide a small coil assembly which includes a closed magnetic path and provides an excellent electromagnetic property.

In order to achieve this object, the present invention provides a coil assembly which includes:

(a) a first magnetic mother board having a flat upper surface;

(b) a coil formed on the first magnetic mother board and composed of stacked coil conductors and insulating layers; and (c) a second magnetic mother board including a recess having a shape corresponding to that of the coil, (d) wherein one side of the first magnetic mother board on which the coil is formed is joined to one side of the second magnetic mother board on which the recess is formed, with the coil being inserted into the recess.

Direct connection of the first and second magnetic mother boards provides a completely closed magnetic path. The insulating layers, which cooperate with the coil conductors to form the coil, include no magnetic materials. The coil assembly thus has an improved electromagnetic property. Since the first magnetic mother board is flat, the coil can be accurately formed on the first magnetic mother board by a printing or photolithographic process. Also, the recess can be accurately formed in the second magnetic mother board by mechanical or other means to form a magnetic path. Thus, the coil assembly is highly accurate and can be made into a compact arrangement.

BRIEF DESCRIPTION OF THE DRAWINGS

The present invention will now be described, by way of example, with reference to the accompanying drawings, in which.

DESCRIPTION OF THE PREFERRED EMBODIMENTS

Reference will now be made to a mother board suitable for producing coil assemblies on a mass production basis. However, it is to be appreciated that a coil assembly can be made one by one. In this embodiment, the present invention is embodied as a transformer, but not limited thereto. It is also applicable to a choke coil, an inductor or other components.

Figure 1:
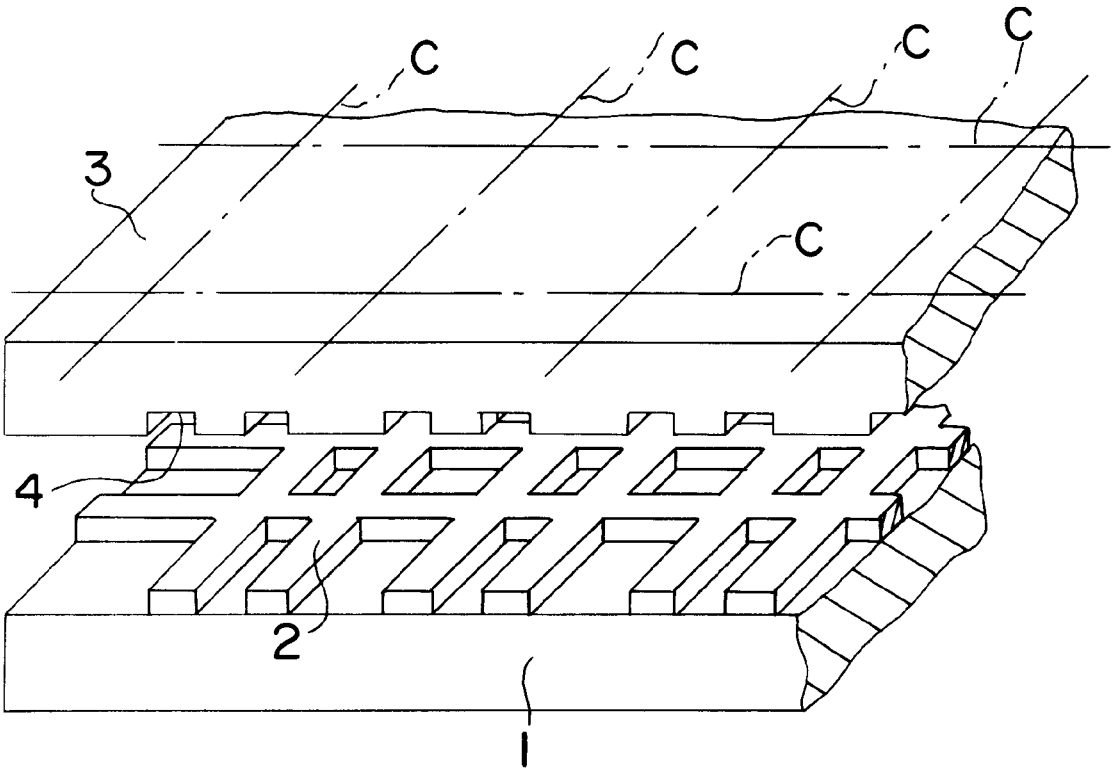
FIG. 1 is an assembly view, in perspective, of a coil assembly according to one embodiment of the present invention.

As shown in FIG. 1, a coil assembly includes a first magnetic mother board 1 and a second magnetic mother board 3. The first and second magnetic mother boards 1 and 3 are both made of a magnetic material such as ferrite. The first magnetic mother board 1 has a flat upper surface and a coil 2 is formed on the upper surface of the first magnetic mother board 1. The coil 2 is composed of coil conductors and insulating materials stacked alternately. The coil 2 is formed in a lattice fashion.

Figure 5:
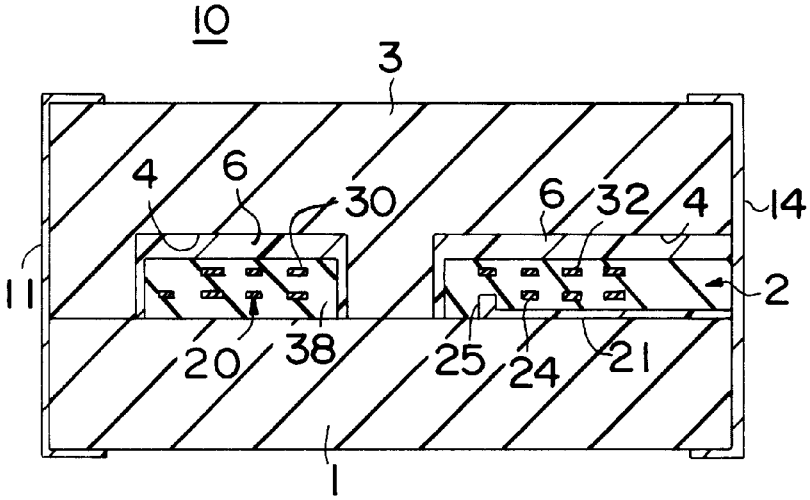
FIG. 5 is a sectional view taken on the line V—V in FIG. 4.
Figure 6:
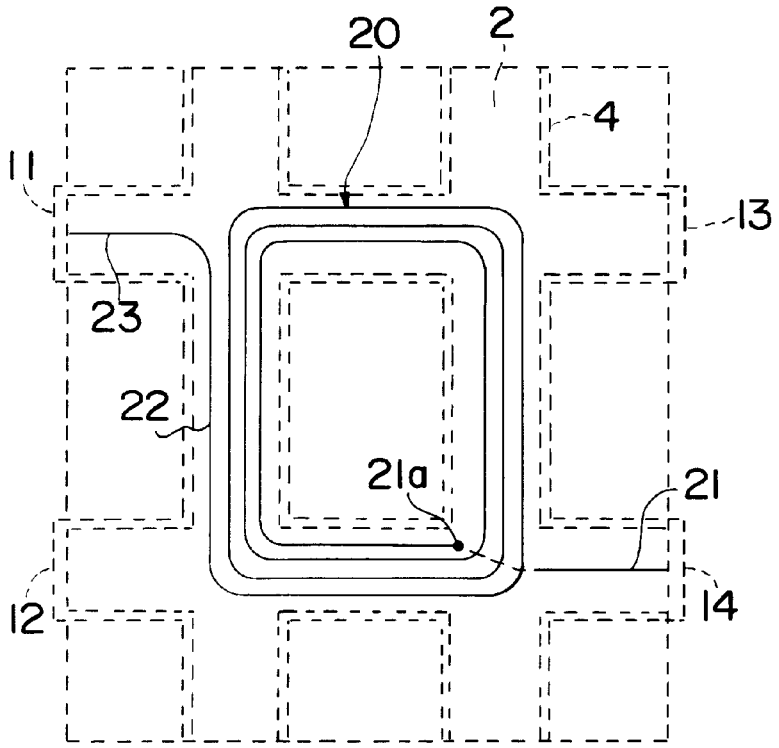
FIG. 6 is a view of a primary coil as seen in the direction of the arrow A in FIG. 4.
Figure 7:
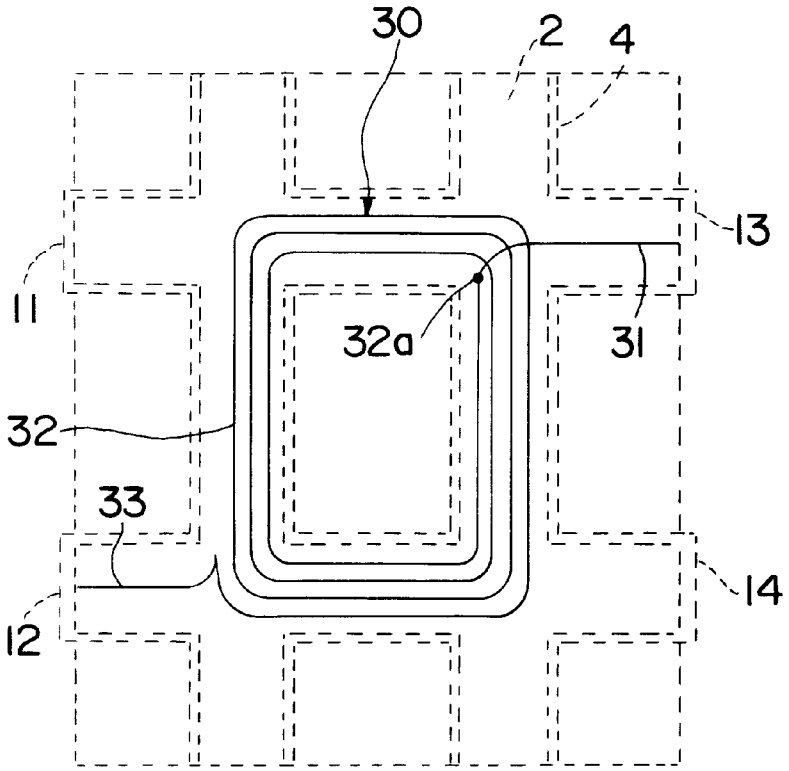
FIG. 7 is a view of a secondary coil as seen in the direction of the arrow A in FIG. 4.

FIGS. 5 to 7 illustrate a method of producing the coil 2. First, as shown in FIGS. 5 and 6, a primary coil lead conductor 21 is formed on the upper surface of the first magnetic mother board 1 by a printing or photolithographic process. The photolithographic process is preferable since it can provide a highly accurate pattern. The lead conductor 21 has one end 21*a* (FIG. 6). An insulating layer 38 is then formed on the upper surface of the first magnetic mother board 1 in a lattice fashion also by a printing or photolithographic process. It should be noted that FIG. 5 shows a plurality of insulating layers 38 collectively, which are in combination with other insulating layers 38 to be formed later. At this time, the end 21*a* of the lead conductor 21 is left uncovered. A spiral primary coil conductor 22 and a lead conductor 23 are formed on the insulating layer 38. The lead conductor 23 extends from the primary coil conductor 22. The end 21*a* of the lead conductor 21 is electrically connected to one end of the primary coil conductor 22. The lead conductors 21 and 23 and the primary coil conductor 22 collectively form a primary coil 20.

Next, as shown in FIGS. 5 and 7 another insulating layer 38 is formed in a lattice fashion to cover the primary coil conductor 22 and the lead conductor 23. Thereafter, a secondary coil conductor 32 and a lead conductor 33 are formed on the insulating layer 38. The lead conductor 33 extends from the secondary coil conductor 32. The secondary coil conductor 32 has one end 32*a*. Then, another insulating layer 38 is formed, but the end 32*a* of the secondary coil conductor 32 is left uncovered. A secondary coil lead conductor 31 is also formed on the insulating layer 38. The end 32*a* of the secondary coil conductor 32 is electrically connected to one end of the lead conductor 31. The lead conductors 31 and 33 and the secondary coil conductor 32 collectively form a secondary coil 30.

The conductors 21 to 23 and 31 to 33 are made of silver, palladium, copper, nickel or alloys thereof. The insulating layer 38 is made of resin such as polyimide or ceramic such as alumina.

Figure 2:
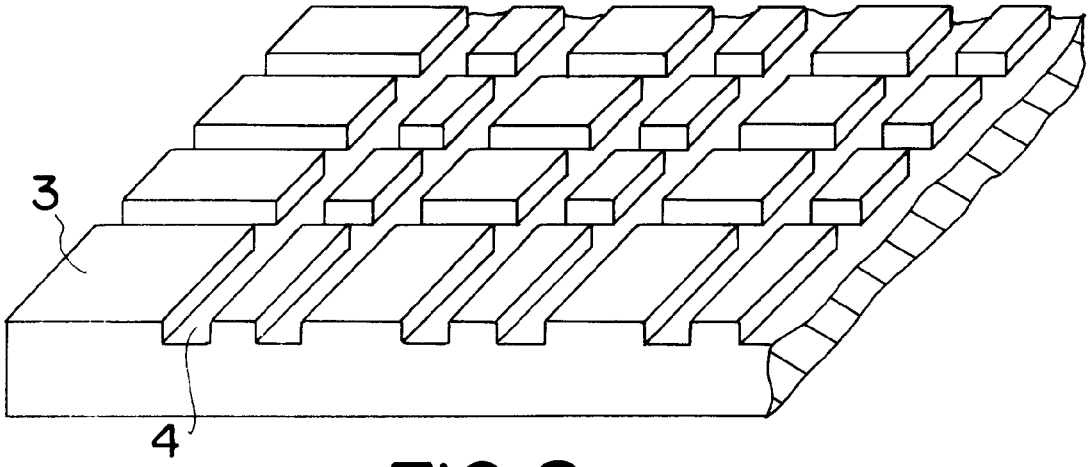
FIG. 2 is a perspective view of a second magnetic mother board shown in FIG. 1, but turned upside down to show a groove.

As shown in FIG. 2, the second magnetic mother board 3 includes a groove 4 arranged in a lattice fashion and having a shape corresponding to that of the coil 2. The groove 4 is formed by a honing process, a press process, a sandblasting process, an ultrasonic process or a photolithographic process. The depth of the groove 4 is slightly greater than the thickness of the coil 2. The depth of the groove 4 is less than, e.g., 0.1 mm, when the coil 2 is made by a photolithographic process.

An adhesive is applied to either one side of the first magnetic mother board 1 on which the coil 2 is formed or one side of the second magnetic mother board 3 on which the groove 4 is formed, or both of these sides. The adhesive is made, for example, of a polyimide resin having thermoplastic characteristics. Thereafter, the coil 2 is inserted into the groove 4 while the first magnetic mother board 1 and the second magnetic mother board 3 are brought into mating engagement with one another. As the mating surfaces of the first and second magnetic mother boards 1 and 3 are very flat, the coil 2 fits closely into the groove 4 to thereby facilitate positioning of the first and second magnetic mother boards 1 and 3.

The first and second magnetic mother boards 1 and 3 are then strongly pressed against one another by means of a vacuum hot press machine. As a result, an excessive amount of adhesive 6 is removed from between the mating surfaces of the first and second magnetic mother boards 1 and 3 to thereby form a complete magnetic path. The adhesive 6 is also filled in any space which may be defined between the groove 4 and the coil 2. This insures full connection between the first and second magnetic mother boards 1 and 3. The groove 4 also provides a space to receive excess adhesive 6 and, thus, minimizes the space between the first and second magnetic mother boards 1 and 3.

Figure 3:
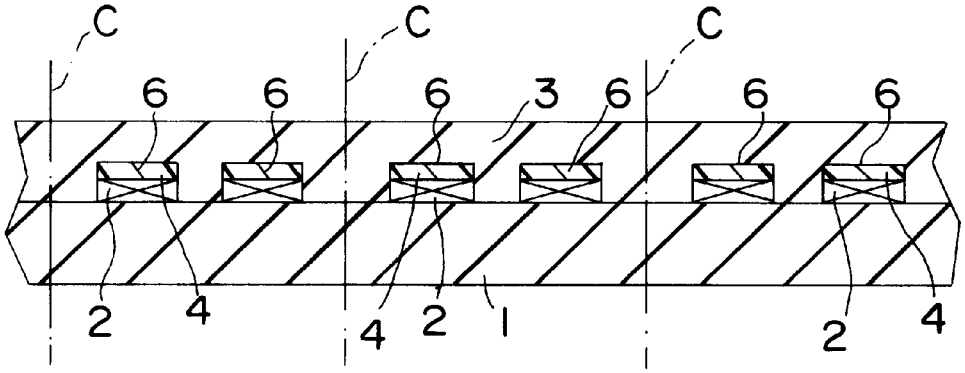
FIG. 3 is a sectional view showing one manufacturing step after the one shown in FIG. 1.
Figure 4:
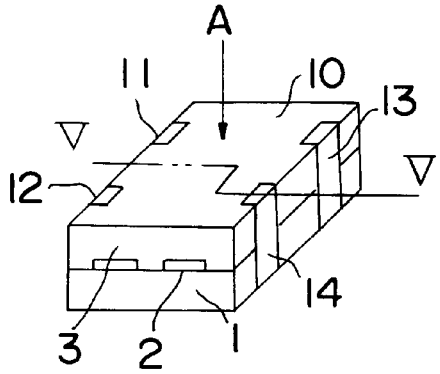
FIG. 4 is a perspective view showing one manufacturing step after the one shown in FIG. 3.
Figure 8:
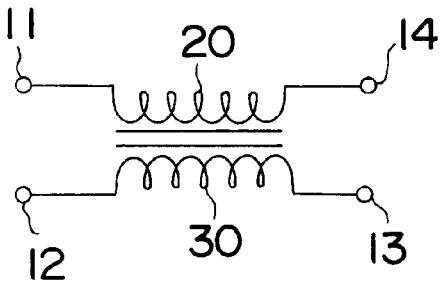
FIG. 8 is a view of an electric equivalent circuit of the coil assembly shown in FIG. 4.

Next, a rotary honestone is used to cut the mother board into a predetermined size along each chain line C to form individual transformers 10 (or coil sub-assembles), as shown in FIGS. 1 and 3. Referring to FIG. 4, external electrodes 11 to 14 are attached to the lateral sides of the transformers 10 by the use of an electrically conductive paste or solder. As shown in FIGS. 5 to 7, the external electrodes 11, 12, 13 and 14 are electrically connected to the lead conductors 23, 33, 31 and 21, respectively. FIG. 8 shows an electric equivalent circuit.

As the first magnetic mother board 1 has no rugged surface, the coil can accurately be formed by a printing or photolithographic process. Also, it minimizes the size of the transformer 10. This is not the case when the first magnetic motherboard has a rugged surface. It is because the conductors 21 to 23 and 31 to 33, if narrow, are subject to deformation. To form a magnetic path, a cutting process is applied to the second magnetic mother board 3 only. The board 3 can accurately be cut since an abrasion process is effected after a sintering process. This is not the case when a molding process is effected after the sintering process. Advantageously, direct connection of the first and second magnetic mother boards 1 and 3 provides a completely closed magnetic path. The insulating layers 38 of the coil 2 include no magnetic materials. This improves electromagnetic connection of the transformers 10. Thus, the transformers 10 can be made into a compact arrangement, provide a closed magnetic path between the first and second magnetic mother boards 1 and 3, and provide a better electromagnetic connection between the primary coil 20 and the secondary coil 30.

The present invention is applied to the coil assembly, but not limited thereto. Various modifications made be made within the spirit and scope of the invention.

Figure 9:
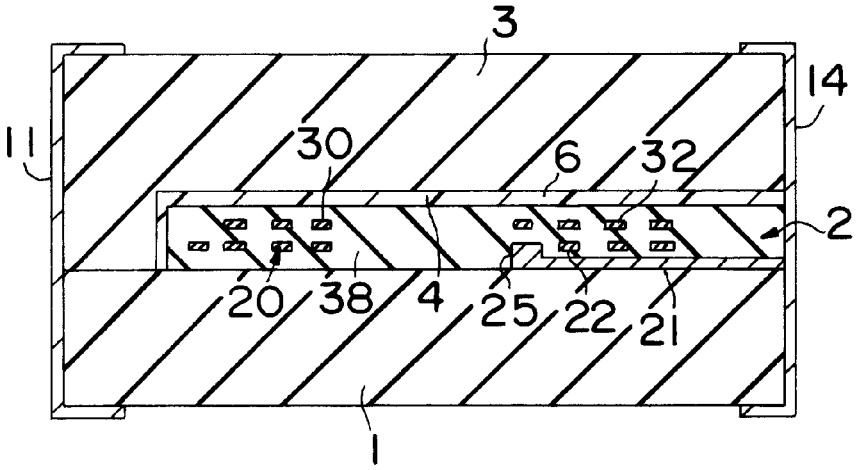
FIG. 9 is a sectional view of a coil assembly according to another embodiment of the present invention.
Figure 10:
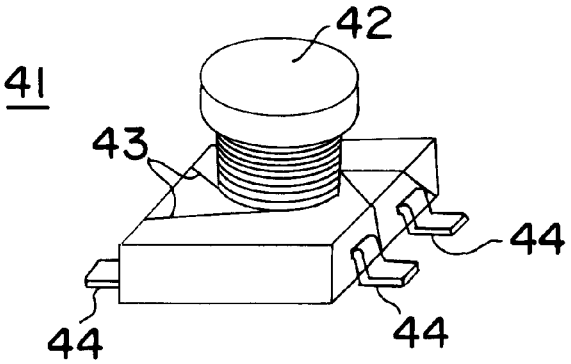
FIG. 10 is a perspective view of a conventional coil assembly.
Figure 11:
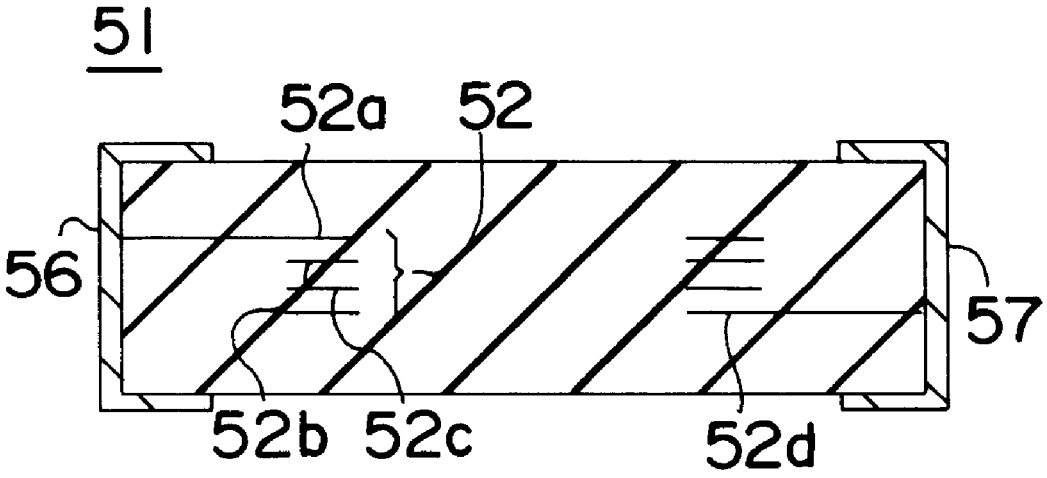
FIG. 11 is a sectional view of another conventional coil assembly.
Figure 12:
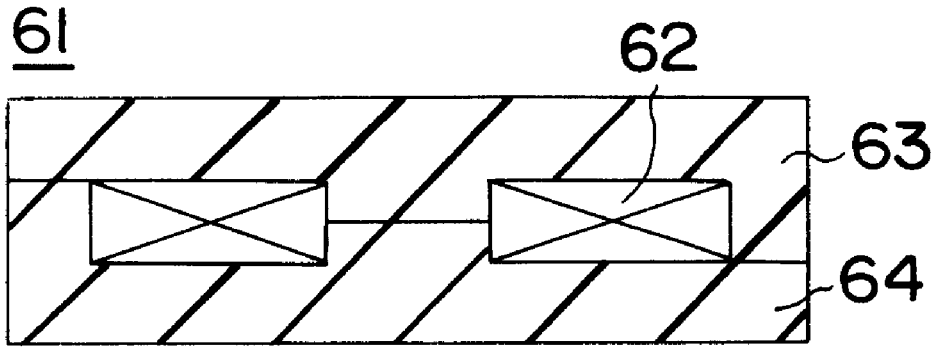
FIG. 12 is a sectional view of a conventional coil assembly.

In the illustrated embodiment, the coil conductor is spiral in shape. Alternatively, it may be arcuate or may take any other shapes as the case may be. As shown in FIG. 9, the coil 2 may not have any magnetic material at its center. The mother board may be cut in a different manner so as to provide a plurality of transformers in series.

As thus far described, direct connection of the first and second magnetic mother boards provides a completely closed magnetic path. The insulating layers, which cooperate with the coil conductors to form the coil, include no magnetic materials. The coil assembly thus has an improved electromagnetic property. Since the first magnetic mother board is flat, the coil can accurately be formed on the first magnetic mother board by a printing or photolithographic process. Also, a magnetic path can accurately be formed since a cutting process is applied to the second magnetic mother board only. Thus, the coil assembly provides a closed magnetic path between the magnetic mother boards, is compact, and provides a better electromagnetic property.

The present invention has been described with respect to its preferred embodiments. However, the invention is not limited to those specific embodiments. It is apparent to those skilled in the art that various modifications and changes may be made without departing from the scope of the invention as defined in the appended claims.

What is claimed is:

1. A coil assembly comprising:

a first magnetic mother board having a flat upper surface;

a coil located on said upper surface of said first magnetic mother board, said coil including stacked coil conductors and insulating layers; and a second magnetic mother board including a recess having a shape corresponding to that of said coil, wherein said upper surface of said first magnetic mother board is joined to one side of said second magnetic mother board on which said recess is formed, with said coil completely encased in said joined first and second magnetic mother boards.

2. A coil assembly according to claim 1, wherein said coil includes a spiral primary coil coaxially positioned next to a spiral secondary coil.

3. A coil assembly according to claim 2, wherein said primary coil and said secondary coil are encased in non-magnetic insulating material.

4. A coil assembly according to claim 1, further comprising an adhesive joining said first magnetic mother board and second magnetic mother board such that a closed magnetic path can be formed said first magnetic mother board and second magnetic mother board.

5. A coil assembly according to claim 4, wherein said recess has a depth greater than a height of said coil accommodate excess adhesive.

6. A coil assembly according to claim 1, further comprising external electrodes electrically connected to said coil.

7. A coil assembly according to claim 1, further comprising a plurality of said coils located on said upper surface of said first magnetic mother board.

8. A coil assembly according to claim 1, further comprising a plurality of electrically connected coils located on said upper surface of said first magnetic mother board.

9. A method of making a coil assembly, said method comprising the steps of:

forming a first magnetic mother board having a flat upper surface;

forming a coil on said upper surface of said first magnetic mother board, said coil including stacked coil conductors and insulating layers; and forming a second magnetic mother board including a recess having a shape corresponding to that of said coil, wherein said upper surface of said first magnetic mother board is joined to one side of said second magnetic mother board on which said recess is formed, with said coil being inserted into said recess such that said coil is completely encased in said joined first and second magnetic mother boards.

10. A method according to claim 9, wherein said step of forming a coil includes forming a first coil on a first insulator, forming a second insulator on said first coil, and forming a second coil said second insulator.

11. A method according to claim 10, wherein said first coil is a primary coil and said second coil is a secondary coil.

12. A method according to claim 10, wherein said steps of forming said first and said second coils include at least one of a photolithographic process and a printing process.

13. A method according to claim 9, wherein said step of forming a second magnetic mother board includes cutting said recess after a sintering process.

14. A method according to claim 9, wherein said step of forming a second magnetic mother board includes cutting said recess by an abrasion process.

15. A method according to claim 14, wherein said step of cutting said recess includes at least one of a honing process, a press process, a sandblasting process, an ultrasonic process and a photolithographic process.

16. A method according to claim 9, comprising the further step of physically connecting external electrodes to said coil assembly, said external electrodes being electrically connected to said coil.

17. A method of making a coil assembly, said method comprising the steps of:

forming a first magnetic mother board having a flat upper surface;

forming a plurality of coils on said upper surface of said first magnetic mother board, each of said coils including stacked coil conductors and insulating layers; and forming a second magnetic mother board including a recess having a shape corresponding to that of said plurality of coils, wherein said upper surface of said first magnetic mother board is joined to one side of said second magnetic mother board on which said recess is formed, with said plurality of coils being completely encased in said first and second mother boards.

18. A method according to claim 17, wherein each of said coils are electrically connected to at least one other coil.

19. A method according to claim if, comprising the further step of cutting said coil assembly into a plurality of coil sub-assembles.

20. A method according to claim 19, comprising the further step of connecting external electrodes to each of said plurality of coil sub-assembles, said external electrodes being electrically connected to said coil within a respective coil sub-assembles.

* * * * *